United States Patent [19]

Johnson

[11] 4,134,334

[45] Jan. 16, 1979

[54] AUTOMATED LOCK DEVICE FOR PRESS FEED BELT DRIVES

[75] Inventor: Kenneth C. Johnson, Des Plaines, Ill.

[73] Assignee: F. J. Littell Machine Company, Chicago, Ill.

[21] Appl. No.: 834,168

[22] Filed: Sep. 19, 1977

[51] Int. Cl.[2] ..... B30B 15/14

[52] U.S. Cl. ..... 100/48; 72/421; 83/240; 83/368; 83/528; 100/53; 100/216; 226/156

[58] Field of Search ..... 100/43, 48, 215, 216, 100/53; 72/404, 405, 421; 83/273, 436, 368, 240, 528; 226/156

[56] References Cited

U.S. PATENT DOCUMENTS

| | | | |
|---|---|---|---|
| 3,613,565 | 10/1971 | Muller | 100/215 |
| 3,638,846 | 2/1972 | Wiig | 226/156 |
| 3,754,705 | 8/1973 | Wiig | 226/156 |

FOREIGN PATENT DOCUMENTS

| | | | |
|---|---|---|---|
| 731900 | 4/1966 | Canada | 100/216 |

*Primary Examiner*—Billy J. Wilhite
*Attorney, Agent, or Firm*—Russell H. Clark

[57] ABSTRACT

In punching, cutting and forming presses and the like, electronic detecting means and/or sensors are provided so as to trip the press and prevent an operation when a mal-function occurs such as a tear in the strip material or a mis-alignment or a mis-feeding of the strip. When the press is equipped with an elbow arrangement to permit adjustments for feed line height while maintaining feed cycle synchronization, then the arrangement must incorporate the automated locking device of the invention, the same automatically unlocking the swing plate simultaneously with the tripping of the press.

7 Claims, 9 Drawing Figures

Figure 1:
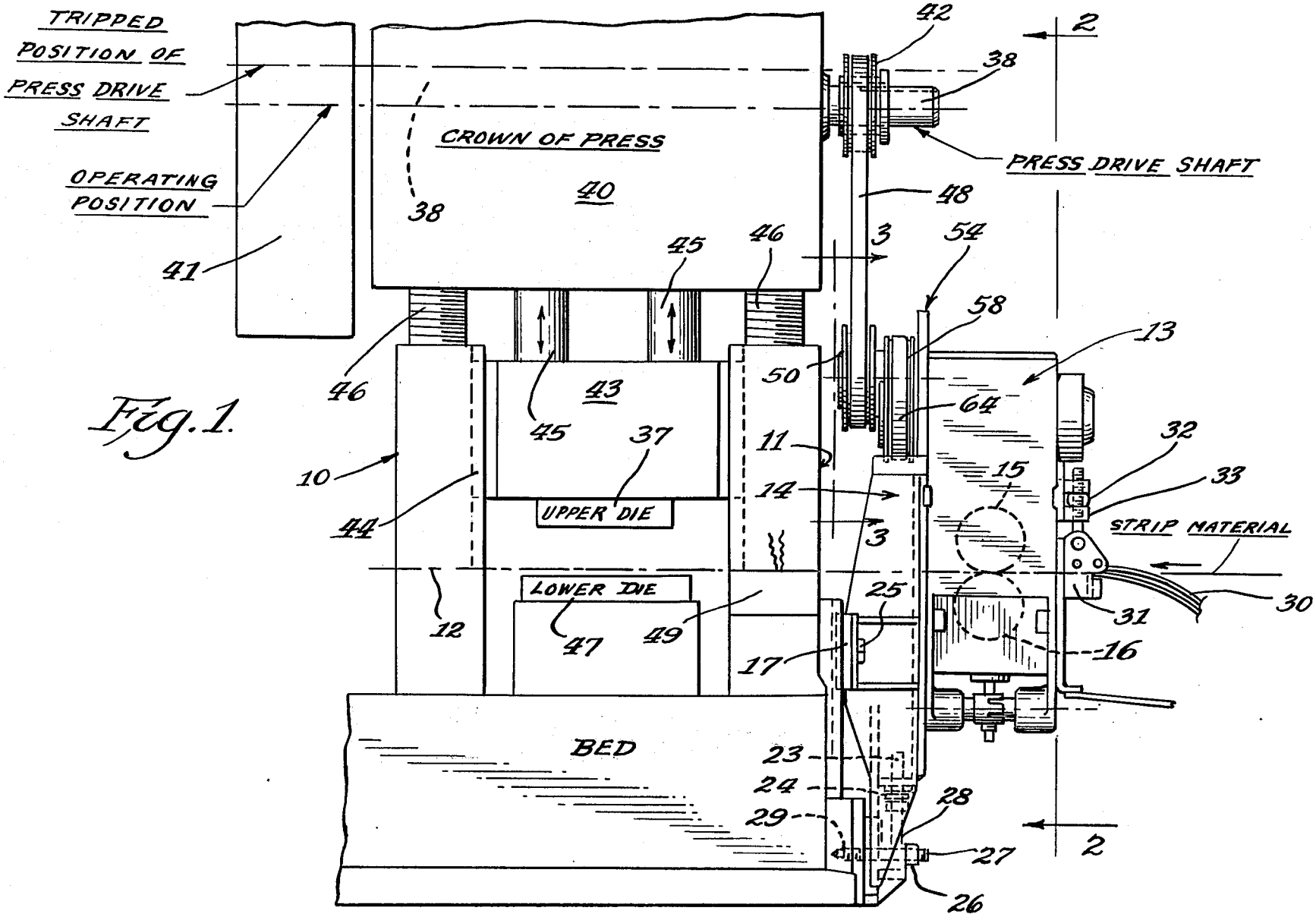

54
64
4
65
5
83
84
92
93
66
67
81
55
35
96
6
85
104
48
95
100
97
98
57
51
58
50

AUTOMATED LOCK DEVICE FOR PRESS FEED BELT DRIVES

The invention relates to belt drives for operatively connecting the main drive shaft of a punching or forming press or the like with the feeding rolls for feeding the strip material and has reference in particular to improvements in a timing belt drive for operatively connecting the press with the lower feed roll, the said incorporating an elbow arrangement designed and constructed to permit adjustments for feed line height while maintaining feed cycle synchronization with the press.

Feeding mechanism for feeding strip material to a press employ a pair of rolls, namely a lower driven roll and an upper idler roll with the strip material passing between. The idler roll is pressure energized towards the lower roll to form the bite on the material to thus cause it to feed forwardly into the press and between the lower stationary die and the movable upper die. Whereas the press drive shaft is driven continuously, the lower feed roll is rotated intermittently, as by means of conjugate cams, for obtaining various feed lengths, which will vary depending on the diameter of the lower feed roll and the extent of its intermittent rotations.

In the apparatus disclosed and claimed in my U.S. Pat. No. 4,063,499 granted Dec. 20, 1977 and entitled Cam Feed With Cycle Synchronization, the input drive shaft for intermittently driving the lower feed roll is journalled by a gear and cam housing with the intermittent rotations being obtained by conjugate cams. By adjusting the vertical positions of the gear and cam housing on the press, the feed line height is accordingly adjusted. More specifically the apparatus includes an elbow arrangement formed by a pair of sprockets and timing belts, with one operatively connecting the press drive shaft with one sprocket and the other belt connecting the other sprocket with the drive shaft for the conjugate cams. By reason of the elbow arrangement, it was possible to make adjustments for feed line height while maintaining synchronized feed cycle and press relationship.

The elbow arrangement requires that the swing plate providing the stud shaft for journalling the sprockets of the elbow be securely locked in its adjusted positions to the back wall of the gear and cam housing. This locking of the swing plate limited the applicability of the device since it could not be employed with those presses wherein the press drive shaft is journalled in a movable crown or top portion of the press and which is caused to move upwardly in the event of certain mal-functions to trip the press, thereby preventing a punching or forming operation from taking place.

Accordingly the present invention has for its main objective to provide automatic unlocking means for the normally locked-up swing plate of an elbow arrangement such as described, whereby to extend the applicability of the elbow arrangement to those presses having electronic detecting means and the like for detecting a mal-function which accordingly trips the press.

Another object of the invention resides in the provision of a pressure cylinder for locking the swing plate of an elbow arrangement such as described when a pressure medium is delivered to the cylinder and wherein the swing plate can be automatically unlocked and released simultaneously with the tripping of the press merely by releasing the pressure medium from the cylinder.

A further object of the invention is to provide a pressure cylinder for releasably locking the swing plate of an elbow arrangement such as described to the back wall of a gear and cam housing and wherein the malfunctions such as will cause a tripping of the press will simultaneously effect a release of the pressure medium from the cylinder to release the swing plate.

With these and other objects in view, the invention may consist of certain novel features of construction and operation as will be more fully described and particularly pointed out in the drawings, specification and claims appended hereto.

Figure 2:
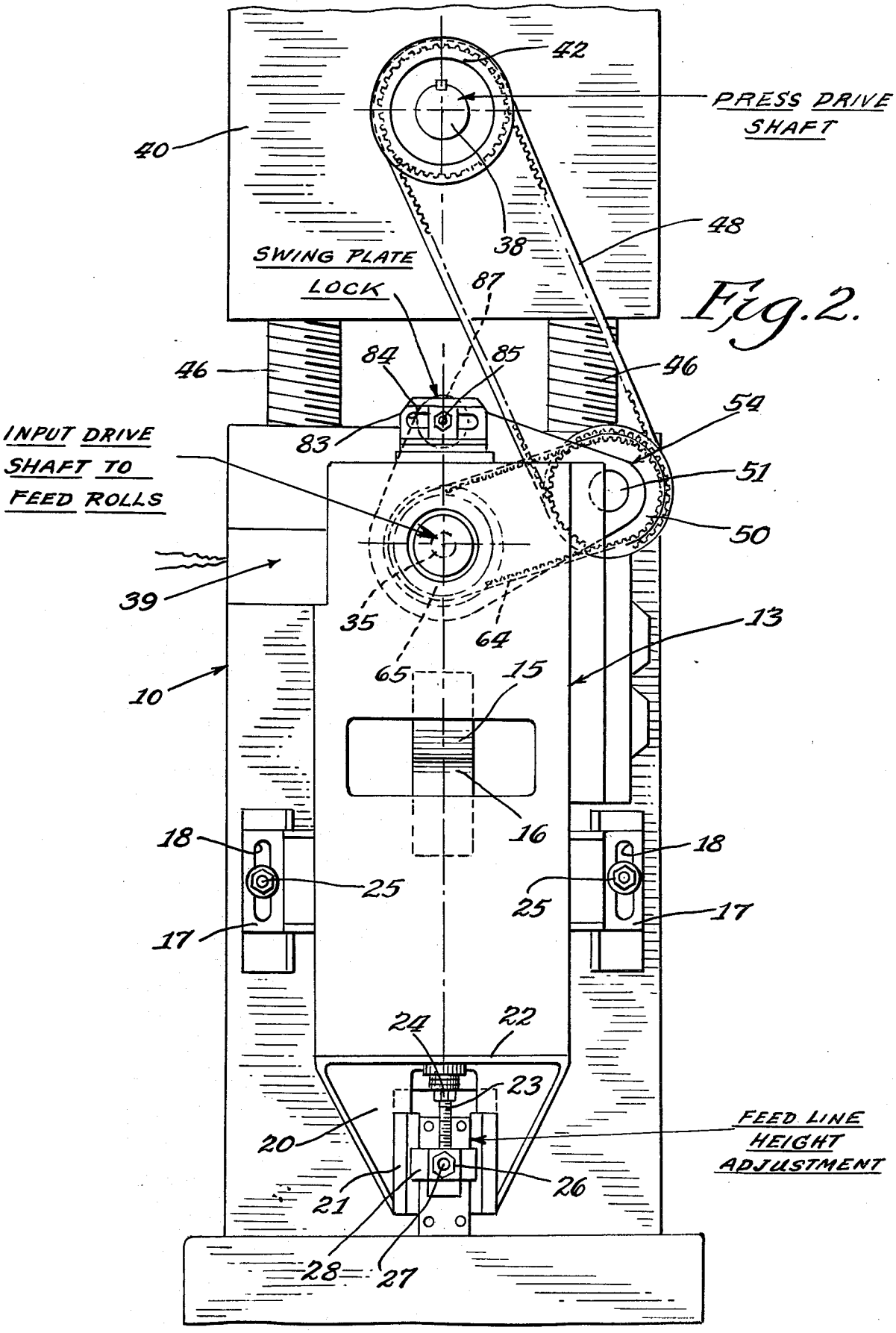
Figure 3:
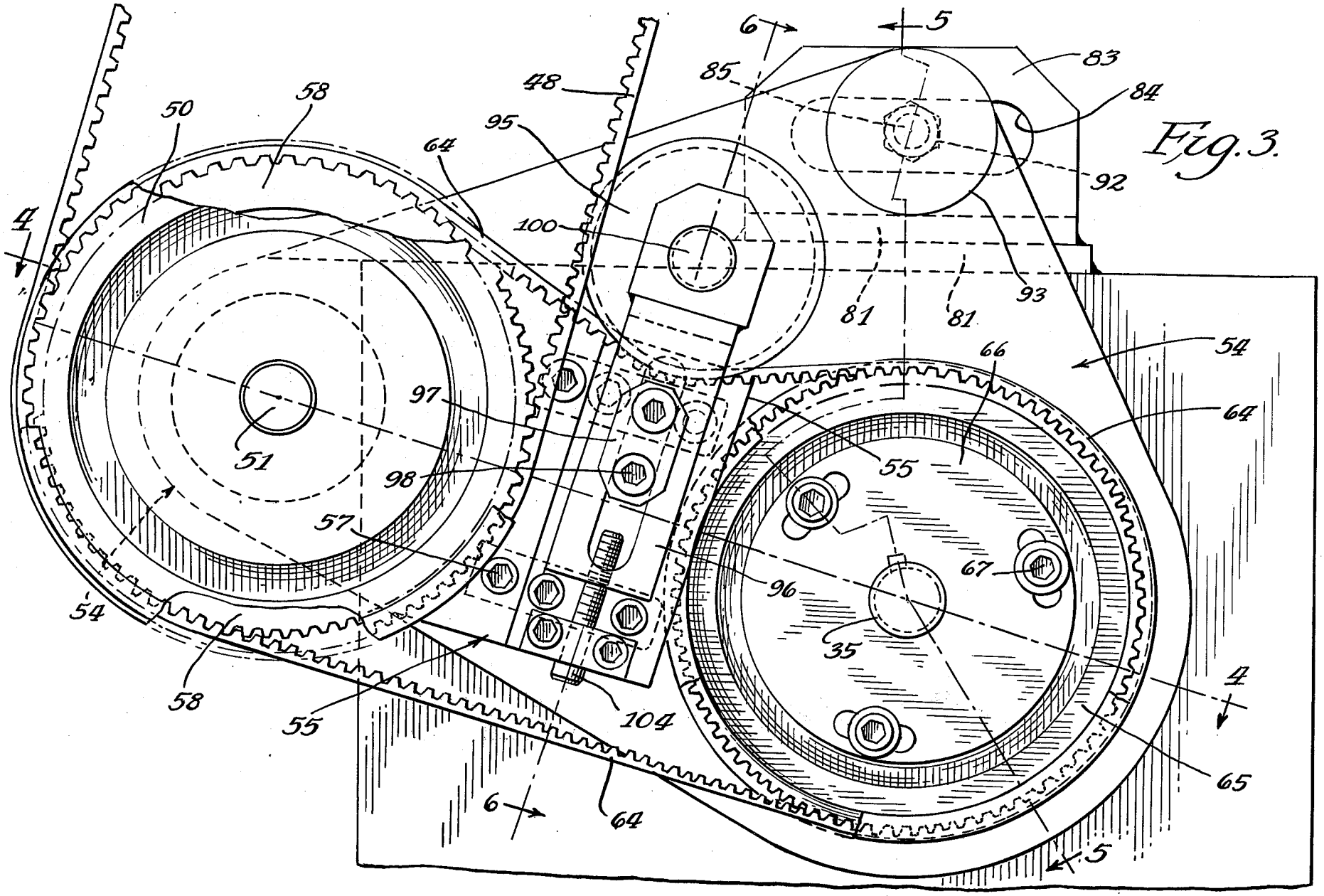
Figure 4:
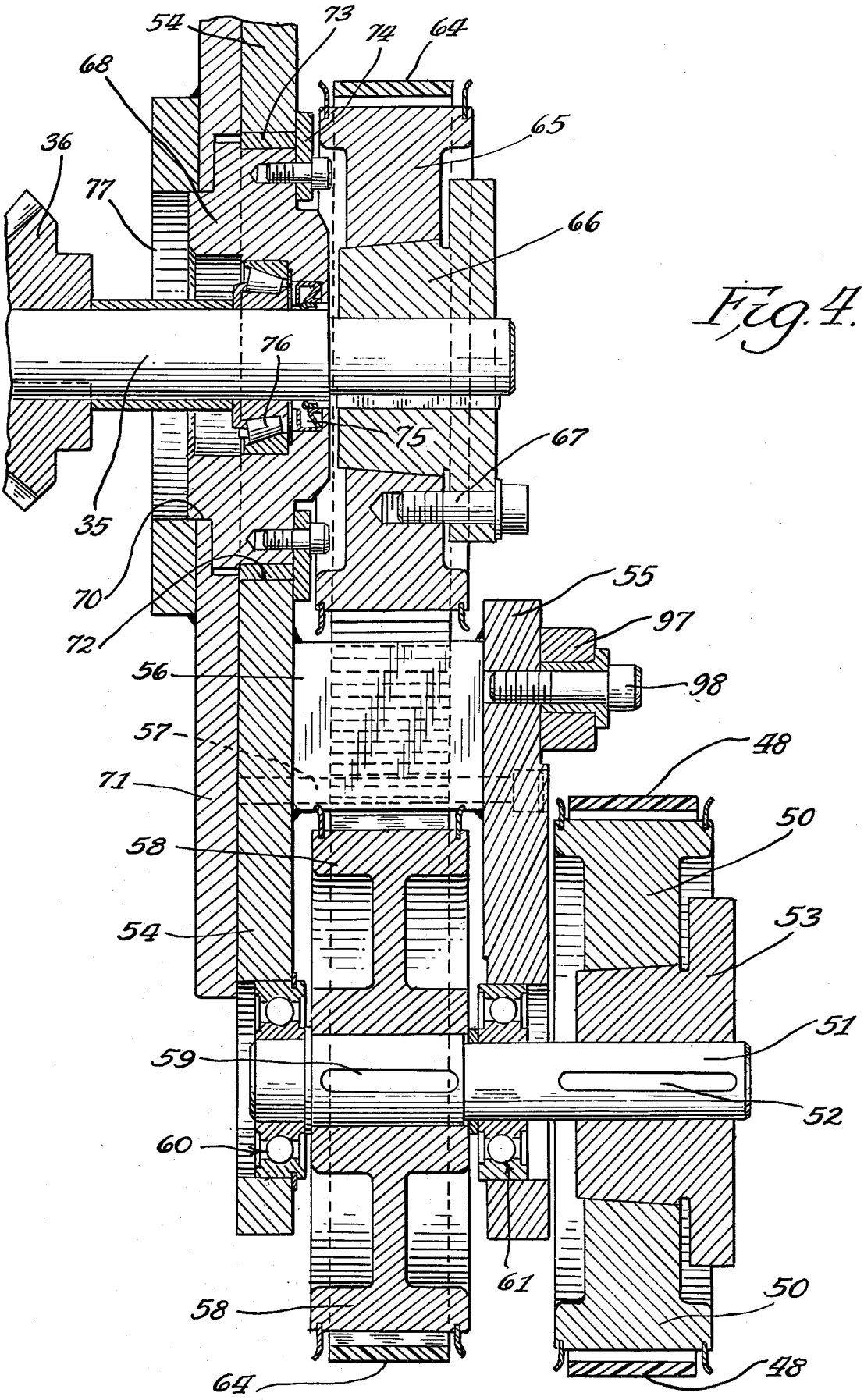
Figure 5:
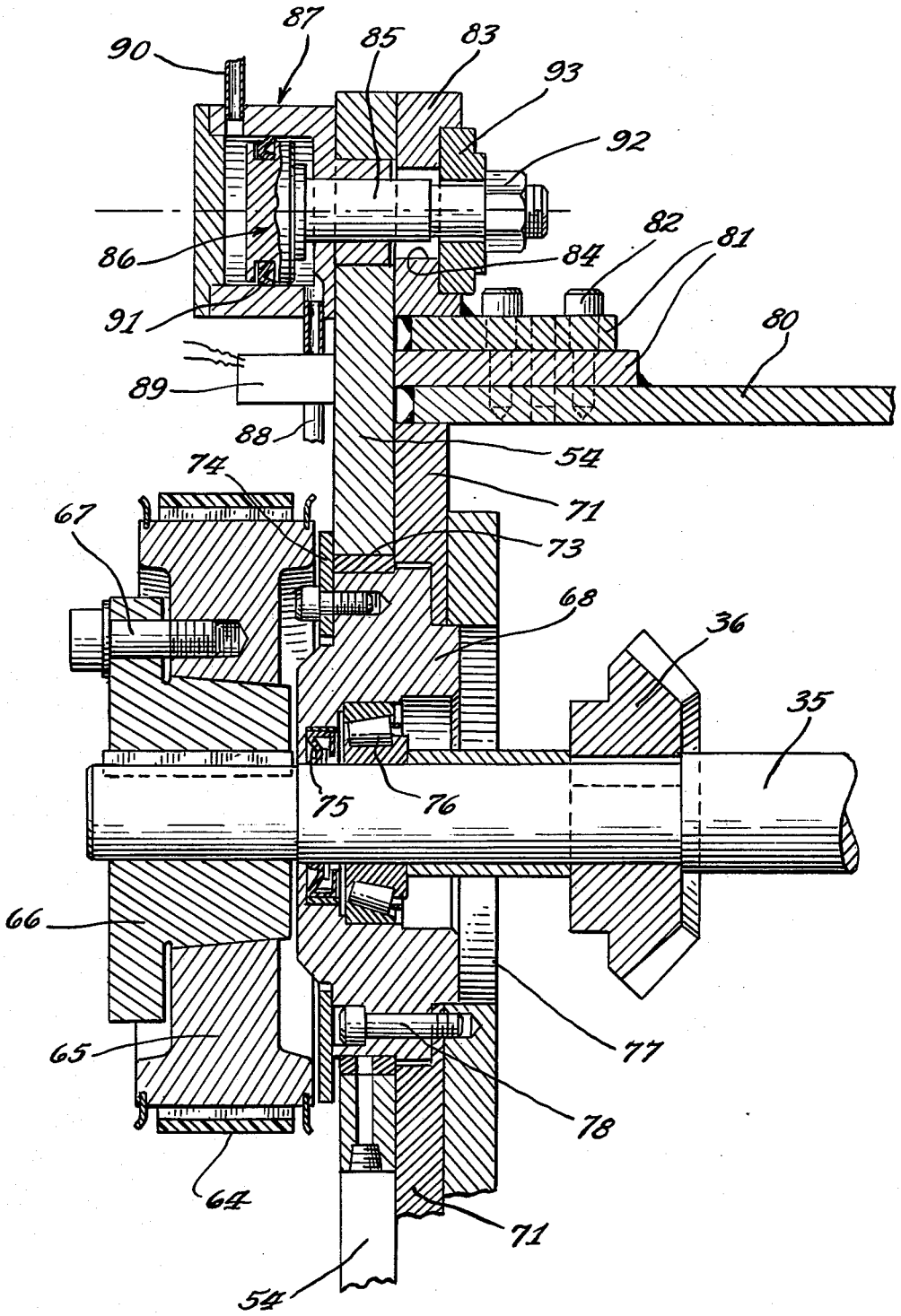
Figure 6:
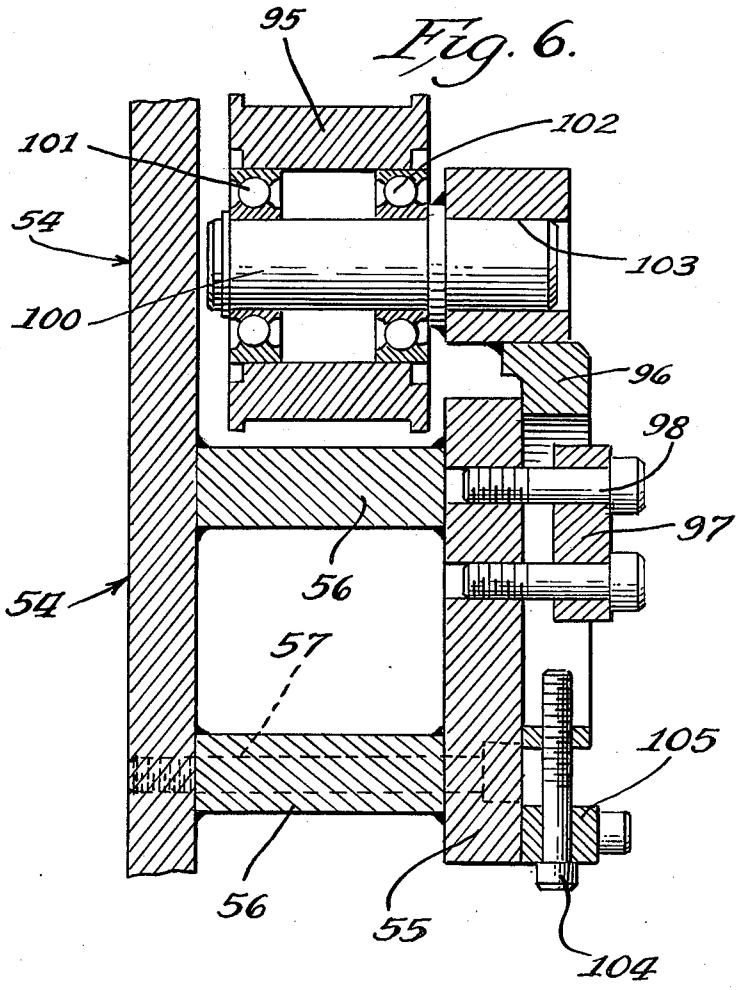
Figure 9:
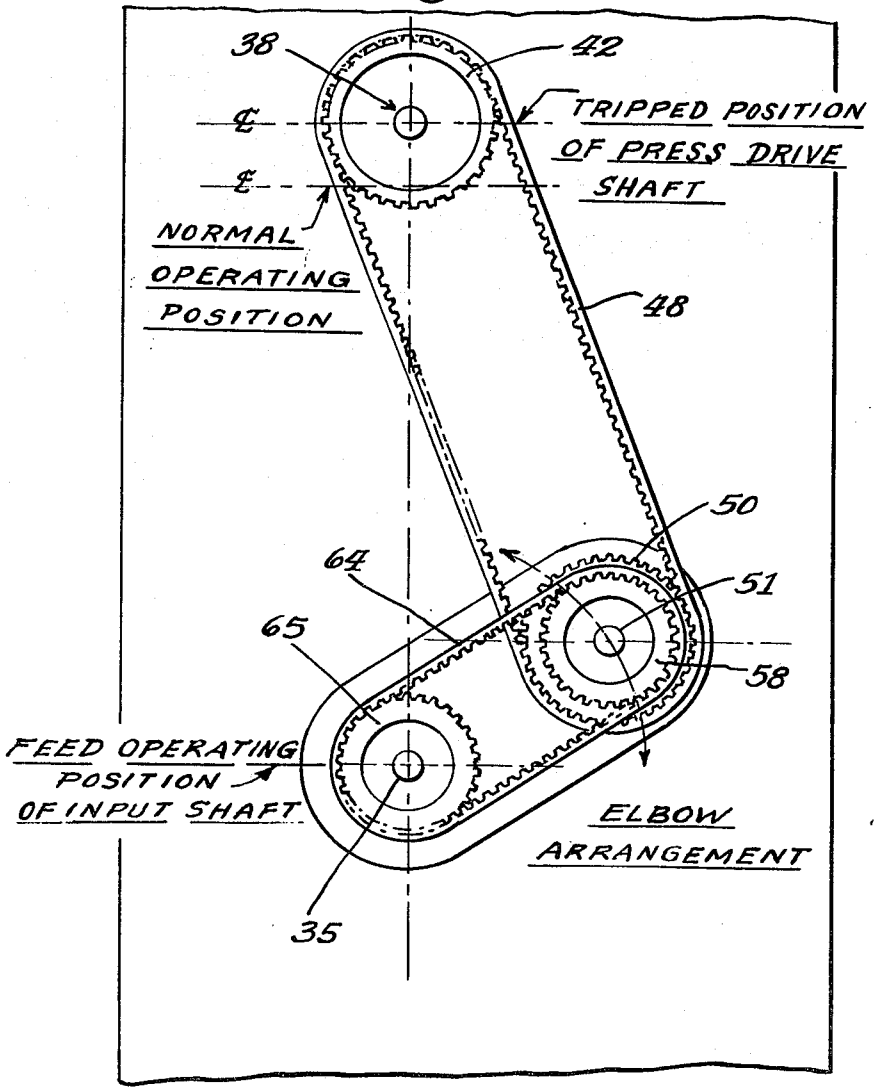
Figure 8:
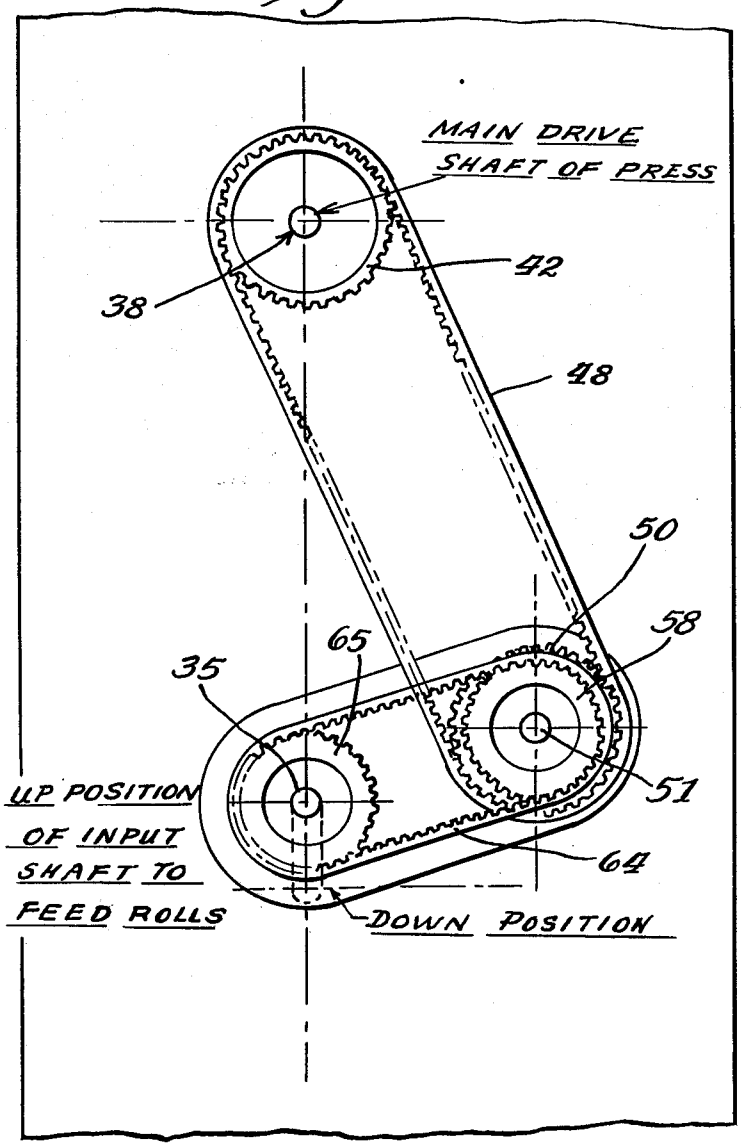
Figure 7:
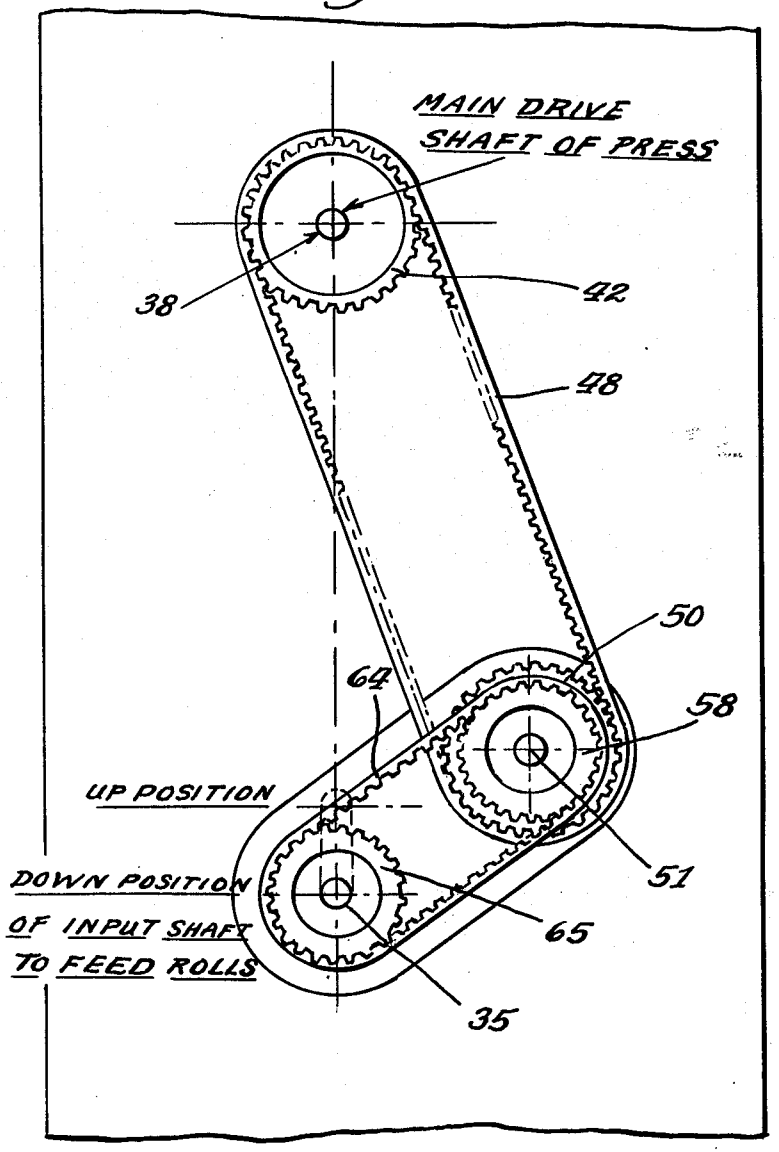

In the drawings which illustrate an embodiment of the invention and wherein like reference characters are used to designate like parts, FIG. 1 is a side elevational view showing a press having its main drive shaft jouranalled in a movable crown which moves upwardly when the press is tripped, the press also having a gear and cam housing in supported relation on its front wall, a flexible timing belt drive is also shown for operatively connecting the main drive shaft with the input shaft for the lower feed roll, the said latter shaft being journalled by the gear and cam housing, FIG. 2 is a front elevational view taken substantially on line 2—2 of FIG. 1, FIG. 3 is a view, mostly in elevation, taken substantially on line 3—3 of FIG. 1 and showing on a larger scale the two timing belts, the swing plate and the arrangement of the several timing sprockets forming the elbow structure of the device, FIG. 4 is a sectional view taken substantially on line 4—4 of FIG. 3, FIG. 5 is a sectional view taken substantially on line 5—5 of FIG. 3 and showing in detail the pressure locking means for releasably locking the swing plate to the rear wall of the gear and cam housing, FIG. 6 is a sectional view taken substantially on line 6—6 of FIG. 3, FIGS. 7 and 8 are elevational views illustrating the manner in which the timing belts and elbow arrangement provide for vertical adjustment of the gear and cam housing on the press, and FIG. 9 is an elevational view similar to FIGS. 7 and 8 but illustrating the action of the elbow arrangement in accomodating a tripping action of the press following a release of the locking means.

The press shown in FIGS. 1 and 2 and identified by numeral 10, is adapted to receive strip material which is fed to the press through an elongated slot in the wall 11 of the press and the feed line height is indicated by 12. The gear and cam housing 13 is suitably fixed to a press adapter bracket 14 which is in turn fixed to the wall 11 in a precise position vertically so that the feed rolls 15 and 16 have an exact position for the particular feed line height. Since the gear and cam housing is carried by the press adapter bracket 14, any vertical adjustment of the housing must be made by adjusting the position of the bracket on the wall of the press and accordingly the bracket is provided with side extensions 17 having elongated slots 18 with the base of the bracket having depending extensions 20 formed with the vertical gibs 21. The bottom wall 22 of the bracket receives the threaded bolt 23 which is locked in adjusted position by the nut 24. This determines the vertical position of the gear and cam housing on the wall 11 of the press. The bolts 25 which pass through the slots 18 and into the said wall can now be tightened and the same action is given to nut 26 on bolt 27. Said bolt passes through the clamp 28 and is threaded into the press wall at 29. By tightening the nut 26, the clamp is held to the gibs 21 and since bolt 23 rests on and is supported by the clamp 28, the depending extensions and the bracket including the supported gear and cam housing all as a unit are releasably fixed to the press wall in the desired vertical position as regards feed line height.

The entrance apron 30 for the strip material is applied to the wall of the gear and cam housing 13 and the attaching fixture 31 is adjustable in a vertical direction by the bolt and nut arrangement 32 which co-acts with the member 33 having a fixed securement to the housing. The input drive shaft 35, FIGS. 2, 4 and 5, journalled in a manner to be presently described, is provided with a bevel gear 36, and as described in my U.S. Pat. No. 4,024,774 granted May 24, 1977 and entitled Modular Cam Driven Roll Feed, the input drive shaft through said bevel gear drives the conjugate cams and accordingly the lower feed roll 16 is driven in an intermittent manner. The intermittent rotations of the lower feed roll are precisely correlated with the vertical reciprocating movements of the upper die 37 of the press. This requires an operable drive connection from drive shaft 38 of the press to the input drive shaft 35 and the structural features of such a drive, which includes an elbow arrangement, is shown in FIGS. 1, 3, 4 and 5.

The press of FIGS. 1 and 2 is characterized by the crown or top portion 40 which suitably journals the shaft 38 to which is fixed the flywheel 41 on the left side and the sprocket wheel 42 on the right side. The slide 43 is mounted for vertical reciprocating movement by the gibs 44 and said slide carries the upper die 37. The slide and thus the die are reciprocated by the drive shaft 38 by means of the crank members 45. The crown 40, including the drive shaft 38, is mounted for press tripping movement by the jack screws 46 which are suitably rotated in either direction by means such as electric motors schematically shown at 39. Pressure cylinders employing a pressure medium, either air or liquid, could be substituted for the jack screws. In a press of this character, electronic detecting means, sensors and the like 49 are associated with the stationary die 47 and they detect any mal-function such as a mis-feeding of the strip material, or mis-alignment, a tear in the strip or a break in the stationary die. Electronic detecting means, sensors and the like such as may be employed in 49 can be obtained from Wintriss Press Controls, Tyco Instrument Division 4 Hartwell Place, Lexington Mass. 02173. The signal picked up by the detecting means 49 trips the press by energizing the electric motors for the jack screws to immediately cause the crown of the press to move up. This upward movement of the crown and the shaft 38 causes the slide 43 and the upper die to also move up and thus any contact of the upper die 37 with the stationary die 47 is prevented.

The press drive shaft 38, sometimes called the press crank shaft, has the timing sprocket 42 suitably mounted thereon and keyed thereto. The timing belt 48 passes around the top arcuate portion of the sprocket 42 and said belt and sprocket have teeth formed on the same for interaction to prevent slippage. The flexible belt 48 extends downwardly to pass around a second timing sprocket 50 mounted on and keyed to the cantilevered end of the stud shaft 51 so as to cause this journalled shaft to rotate. Since sprokets 42 and 50 have the same effective diameter, the stud shaft will rotate at the same speed. Second sprocket 50 is keyed to the stud shaft at 52 by means of the hub portion 53 and the sprocket and its journalling shaft 51 are part of the elbow of the belt drive which also includes the swing plate 54 and the plate member 55 secured to the swing plate by the spacing element 56 and the securing bolt 57. The elbow is completed by a third timing sprocket 58 also keyed as at 59 to the stud shaft 51 which is mounted for rotation on the swing plate 54 by the ball bearing unit 60. Thus both the second and third sprockets 50 and 58 rotate together since they are keyed to the stud shaft, and because they do the stud shaft is strengthened by the intermediate bearing unit 61 located in plate member 55.

The flexible belt drive from the press drive shaft to the second and third timing sprockets is continued by a second timing belt 64 which operatively connects the third sprocket 58 to a fourth sprocket 65 suitably mounted on the input shaft 35. Said fourth sprocket is keyed and held to the input shaft by the hub portion 66, and by the securing bolts 67 which provide for rotative adjustments between the sprocket and the input shaft. After the desired rotative adjustments of the sprocket on the hub portion has been obtained, then the parts are secured together by the bolts 67 which pass through arcuate openings in the hub portion for threaded securement in the sprocket. Shaft 35 has the bevel gear 36 fixed thereto and the shaft extends from the sprocket 65 through journalling means retained and mounted in the hub portion 68 which has interfitting relation in opening 70 in the wall 71 of the gear and cam housing 13. The bevel gear is thus located within the housing for meshing relation with another gear for driving the lower feed roll 16.

The hub portion 68 is additionally located within an opening 72 in the swing plate 54 which is larger in diameter than the hub portion to provide an annular space for the ring bushing 73, retained in place by the washer 74. An oil ring 75 is located adjacent the bearing unit having the tapered bearings 76. The hub portion 68 is secured to the rear housing wall 71 and to the reinforcing wall 77 by the bolts 78, FIG. 5. The shaft 35 and the hub portion 68 and also the ring bushing 73 thus provide the center for the limited rotative adjustments of the swing plate. Said plate can be rotated for adjustment on the ring bushing 73 and around the input shaft 35 as an axis. Hub portion 68 has a close interfitting relation in opening 70 in the wall of the housing 13 and likewise in a similar aligned opening in the reinforcing wall 77. The supporting means for the swing plate on the gear and cam housing will now be described.

The housing has a top wall 80, FIG. 5, suitably joined and connected as by welding to the rear wall 71 and which is reinforced at its connection to said wall by a pair of plates or discs 81 being welded and also secured to the top wall by the bolts 82. The base clamp element 83 is also part of the plate-like reinforcing means being secured to the wall 71 of the gear and cam housing, and the element 83 is formed with a horizintal opening 84 through which the piston rod 85 extends, FIG. 3.

The piston rod is part of the automated locking means of the invention and which normally locks the swing plate 54 to the rear wall 71 of the gear and cam housing 13. The piston rod is integral with the piston 86 having location within the cylindrical wall of the pressure cylinder 87. Said cylinder can be supplied with a pressure medium, either air or liquid, through the inlet tube 88 connecting with the cylinder on the right side of the piston 86 and in a similar manner the drain conduit 90 connects with the cylinder on the left side of the piston, FIG. 5. Said piston is equipped with a sealing ring 91. The pressure medium admitted to the cylinder through the inlet tube 88 occupies the space on the right hand side of the piston and thus the piston 86 and the piston rod 85 are caused to move to the left. This causes the nut 92 threaded on the end of the piston rod to contact the washer 93 and said washer in turn contacts the base clamp element 83. As more pressure is applied, the base clamp element tightens up against the swing plate 54 which is accordingly clamped between the element 83 and the base of the cylinder 87. The result of this clamping is to lock the swing plate to the rear wall of the housing. The locking action is of course releasable since it is only necessary to release the pressure on the medium in the space on the right hand side of the piston 86 and the clamping action on the swing plate is immediately released. This pressure release can be accomplished by the opening of the valve means 89 schematically shown, FIG. 5, in associated relation with the inlet tube or conduit 88 and said valve means can be actuated electrically by the same signal which trips the press. Valve means as shown schematically at 89 for directing fluid flow may consist of a solenoid operated directional valve such as shown in bulletin 517.380-1-2 of Sperry-Vickers, Troy, Michigan 48084. As the press drive shaft moves upwardly when the press is tripped, the elbow structure will also move upwardly since the swing plate is free, having been unlocked and released simultaneously with the tripping action.

Flexible timing belts have a tendency to elongate with use and also a replacement belt may not have exactly the same length as the belt it replaces. Thus undesirable slack develops and means must be provided to take up such slack whenever it occurs. The timing belt 48 is not involved since any slack in the belt can be taken up at the elbow by a minor adjustment of the swing plate. However the timing belt 64 cannot be tightened except by means of an idler roller since the spaced shafts 51 and 35 are fixed in spaced relation. The idler roller 95 is shown in FIGS. 3 and 6 as is also the idler roller support 96, which is adjustably secured by the clamp 97 and by the bolts 98 to the journalling plate 55. The idler roller has contact with the outside surface of the belt 64 and as shown in FIG. 6 the roller is mounted for rotation on the stud shaft 100 by means of the ball bearing units 101 and 102. The stud shaft is suitably fixed to the idler roller support 96 by welding and by having a tight fit in opening 103. Up and down adjustment of the roller support is provided for by the threaded adjusting screw 104 which passes through the part 105 of the journalling plate 55 to have threaded relation with the base of the idler roller support.

In operation of a press as described having a timing belt drive incorporating an elbow arrangement, the input drive shaft 35 can be adjusted vertically on the press to achieve the precise feed line height and the synchronization of the feed cycle with respect to the movable die 37 can be maintained. The timing sprockets 42 and 50 have the same effective diameter and likewise as regards the sprockets 58 and 65, so that the input shaft has the same speed as the press crank shaft. In setting up the gear and cam housing for an operation, the electric control valve 89 associated with the inlet conduit 88 is opened to release pressure on the medium within the space to the right of the piston and accordingly release the swing plate 54. After obtaining the desired feed line height, the pressure medium is again delivered to the cylinder 87 through the inlet conduit 88 to securely lock the swing plate to the rear wall 71 of the housing 13. The electric control valve is then caused to close and thus the swing plate is maintained in a locked condition. This locked condition continues during operation until a mal-function of the press occurs such as is detected by the detecting means 49 associated with the lower die 47. The signal thus produced is delivered to the electric motors 39 to cause actuation of the jack screws 46 and a tripping of the press takes place. The signal from the detecting means 49 is also delivered to the electric control valve 89 associated with the inlet conduit 88 to cause the same to open to release the pressure on the medium to the right of the piston in cylinder 87 and which up to now was holding the swing plate 54 in a locked condition. The swing plate is thus released simultaneously with the tripping of the press, and the swing plate is free to move up with the crown of the press. This up movement of the swing plate is a counter-clockwise rotation of the same around the input drive shaft as an axis.

FIGS. 7 and 8 show the action of the elbow arrangement when the input drive shaft 35 is adjusted to its maximum extent up and down with no change in the operating position of the press drive shaft 38. FIG. 9 illustrates the action of the elbow arrangement when the press is in an operating position and when the press is in a tripped position, with no change in the position of the input drive shaft.

What is claimed is:

1. In press feeding mechanism for feeding strip material, in combination with the crank drive shaft of a press, of a gear and cam housing having an adjustable securement to a wall of the press in associated relation to the crank drive shaft, said gear and cam housing journalling a feed roll and having an input drive shaft for driving the feed roll, a swing plate mounted on the input drive shaft for limited rotative adjusting movement around said drive drive shaft as an axis, pressure cylinder means for releasably locking the swing plate to a wall of the gear and cam housing, an elbow arrangement provided by the swing plate and including a pair of timing sprockets in spaced parallel relation and carried by the swing plate in a manner permitting rotation as a unit, a flexible belt drive operatively connecting the press crank shaft with one of the timing sprockets, and a second timing belt operatively connecting the other timing sprocket with the input drive shaft.

2. Press feeding mechanism for feeding strip material as defined by claim 1, wherein the pressure cylinder means includes a piston adapted to reciprocate within a pressure cylinder, a piston rod integral with the piston and which projects from the base of the cylinder and extends through an opening in the swing plate and through an aligned opening in a base clamp member fixed to the rear wall of the gear and cam housing, whereby the swing plate is confined between the base of the cylinder and the base clamp member when the pressure cylinder means has locking action for locking the swing plate to a wall of the gear and cam housing.

3. Press feeding mechanism for feeding strip material as defined by claim 2, additionally including an inlet conduit connecting with the pressure cylinder for admitting a pressure medium to that side of the piston from which the piston rod extends.

4. Press feeding mechanism for feeding strip material as defined by claim 3, additionally including an electric control valve in operative associated relation with the inlet conduit.

5. In press feeding mechanism for feeding strip material, in combination with the crank drive shaft of a press capable of being tripped which results in the crank drive shaft moving upwardly, of a gear and cam housing having an adjustable securement to a wall of the press for obtaining the desired feed line height, said gear and cam housing journalling a feed roll and having an input drive shaft for driving the feed roll, a swing plate mounted on the input drive shaft for limited rotative adjusting movement around the input shaft as an axis, pressure cylinder means for releasably locking the swing plate to the rear wall of the gear and cam housing, an elbow arrangement provided by the swing plate and including flexible belts operatively connecting the crank drive shaft of the press with the input drive shaft, and a control valve in operative associated relation with the pressure cylinder means and capable of being controlled electrically, whereby the swing plate can be released simultaneously with the tripping of the press.

6. Press feeding mechanism for feeding strip material as defined by claim 5, wherein the pressure cylinder means includes a piston adapted to reciprocate within a pressure cylinder, a piston rod integral with the piston and which projects from the base of the cylinder and extends through an opening in the swing plate and through an aligned opening in a base clamp member fixed to the rear wall of the gear and cam housing, whereby the swing plate is confined between the cylinder and the base clamp member when the pressure cylinder means has locking action for locking the swing plate to the rear wall of the gear and cam housing, and additionally including an inlet conduit connecting with the pressure cylinder for admitting a pressure medium to that side of the piston from which the piston extends, the said control valve having operative associated relation with the inlet conduit.

7. Press feeding mechanism for feeding strip material as defined by claim 5, additionally including a stationary die for the press and a movable die actuated by the crank drive shaft, detecting means for detecting a malfunction in press operation and for producing an electric signal to trip the press to prevent the movable die from co-acting with the stationary die, and means operative to deliver said electric signal to the control valve to cause the valve to open and thereby release the locking action of the pressure cylinder means on the swing plate.

* * * * *